US011871835B2

(12) United States Patent
Brown et al.

(10) Patent No.: US 11,871,835 B2
(45) Date of Patent: Jan. 16, 2024

(54) MODULAR BELT SYSTEM WITH PASS-THROUGH FOR SAFETY TIE-IN POINT

(71) Applicant: Eagle Industries Unlimited, Inc., Virginia Beach, VA (US)

(72) Inventors: Kory K Brown, Franklin, VA (US); Caitlin Barber, Virginia Beach, VA (US); Don Gallo, Virginia Beach, VA (US)

(73) Assignee: Eagle Industries Unlimited, Inc., Virginia Beach, VA (US)

( * ) Notice: Subject to any disclaimer, the term of this patent is extended or adjusted under 35 U.S.C. 154(b) by 282 days.

(21) Appl. No.: 17/471,096

(22) Filed: Sep. 9, 2021

(65) Prior Publication Data

US 2022/0071376 A1 Mar. 10, 2022

Related U.S. Application Data

(60) Provisional application No. 63/076,334, filed on Sep. 9, 2020.

(51) Int. Cl.
*A45F 3/14* (2006.01)
*A45F 3/00* (2006.01)

(52) U.S. Cl.
CPC ..... *A45F 3/14* (2013.01); *A45F 2003/001* (2013.01); *A45F 2003/144* (2013.01)

(58) Field of Classification Search
CPC ..... A45F 3/14; A45F 2003/001; A45F 2003/144; A45F 5/02; A45F 5/021; A41F 9/025
USPC .... 224/671; 2/311, 312, 316, 317, 321, 322, 2/338
See application file for complete search history.

(56) References Cited

U.S. PATENT DOCUMENTS 4,384,372 A * 5/1983 Rector ..... A41F 9/002 224/684
4,413,358 A * 11/1983 Jimenez ..... A41F 9/005 2/311
4,964,401 A * 10/1990 Taigen ..... A61F 5/028 482/106
5,464,136 A * 11/1995 Eddy ..... F41C 33/046 2/322
5,586,969 A * 12/1996 Yewer, Jr. ..... A61F 5/028 2/311
5,819,320 A * 10/1998 Jolla ..... A41F 9/00 2/227

(Continued)

OTHER PUBLICATIONS

"Grey Ghost Gear UGF Battle Belt with Padded Inner" (Accessed Jun. 10, 2020).

(Continued)

*Primary Examiner* — Nathan J Newhouse
*Assistant Examiner* — Lester L Vanterpool
(74) *Attorney, Agent, or Firm* — Reed Smith LLP; Matthew P. Frederick; Cheryl L. Gastineau

(57) ABSTRACT

Devices and methods for providing an integrated belt assembly providing a tie-in point for a safety retention lanyard. In some embodiments, inner and outer belts are provided as coextensive and removably attached. The outer belt has a pass-through window to accommodate a rigger loop of the inner belt. In some embodiments, a method of equipping inner and outer belts is provided.

20 Claims, 14 Drawing Sheets

(56) References Cited

U.S. PATENT DOCUMENTS 6,264,081 B1 * 7/2001 Wojciak ..... B25H 3/00 224/660
6,336,908 B1 1/2002 Slautterback
6,481,528 B2 11/2002 Antonia
D480,535 S * 10/2003 Hammond ..... A45F 5/02 D2/627
6,701,534 B2 3/2004 Guibord
7,103,921 B1 * 9/2006 Shoemaker ..... A61F 13/085 2/312
D568,579 S * 5/2008 Mouquet ..... D2/624
7,575,136 B2 * 8/2009 Kernkamp ..... A47D 13/025 224/159
8,235,173 B2 * 8/2012 Kopp ..... A62B 35/0012 182/7
8,474,673 B2 * 7/2013 Murdoch ..... A45F 5/02 224/675
8,707,523 B2 4/2014 Fraze
D753,244 S * 4/2016 Hovey ..... D21/662
9,339,102 B2 * 5/2016 Iosilevich ..... A45F 3/14
9,581,414 B1 2/2017 Mironski
D850,101 S * 6/2019 Mironski ..... D3/224
10,898,750 B1 * 1/2021 Angulo ..... A63B 21/0552
11,266,224 B2 * 3/2022 Landano ..... A41F 9/02
11,517,061 B2 * 12/2022 May ..... A45F 5/02
2009/0235431 A1 * 9/2009 Bevley ..... A41F 9/00 2/338
2012/0055894 A1 3/2012 Cabana
2014/0075650 A1 3/2014 Garrison et al.
2016/0227861 A1 8/2016 May
2017/0000249 A1 * 1/2017 Beck ..... A41F 9/002
2019/0133306 A1 5/2019 Satterfield

OTHER PUBLICATIONS

"TMC Tactical belt Cobra1.75-2inch One-pcs Combat Belt Nylon AustriAlpin Buckle D-Ring Hunting Accessories", (Accessed Jun. 10, 2020).

* cited by examiner

MODULAR BELT SYSTEM WITH PASS-THROUGH FOR SAFETY TIE-IN POINT

CROSS-REFERENCE TO RELATED APPLICATION

This application claims the benefit of U.S. Provisional Application No. 63/076,334, filed Sep. 9, 2020, the disclosure of which is incorporated by reference herein.

FIELD OF THE INVENTION

The present invention is directed to safety retention belts, utility belts, and an integrated implementation of a safety retention belt with a second belt.

BACKGROUND OF THE INVENTION

A variety of belts and straps serving different purposes may be utilized by a user, for example military personnel. A retention belt is safety-rated to withstand fall loads while securely holding the wearer and includes an anchoring point for a tether (e.g., a safety tether affixed to a helicopter). A utility belt selectively holds a variety of tools, munitions, and other supplies.

SUMMARY OF THE INVENTION

An integrated belt assembly comprising an inner belt and an outer belt is provided. In embodiments, a utility belt for integration with a safety belt is provided. In other embodiments, a method of equipping an inner belt and an outer belt is provided.

In certain embodiments, an integrated belt assembly, comprises an inner belt configured to fit in the belt loops of a wearer's pants, the inner belt defining an inner face and an outer face, the inner belt comprising: a sleeve member, a padding member extending through the sleeve, a strap extending through the sleeve member and comprising a unitary rigger loop extending from the outer face, the strap being fall-rated, wherein the unitary rigger loop is integrally formed from the strap of the inner belt by folding the strap upon itself, wherein the unitary rigger loop extends parallel to a longitude of the inner belt, a first buckle affixed to the strap for closing the inner belt, a first fastener of a hook-and-loop fastener interface provided at the outer surface of the inner belt; and an outer belt defining an inner surface and an outer surface, the outer belt comprises: a pass-through window formed in the outer belt and sized to accommodate the unitary rigger loop, a plurality of carriers provided on the outer surface of the outer belt, a second buckle affixed to the outer belt for closing the outer belt, and a second fastener of a hook-and-loop fastener interface provided at the inner surface of the outer belt for selectively attaching to the first fastener with the unitary rigger loop extending through the pass-through window.

In certain embodiments, the unitary rigger loop is laterally compressed and reinforced relative to the remainder of the belt.

In certain embodiments, the strap, the unitary rigger loop, and the first buckle provide a fall-rated tensile strength.

In certain embodiments, the pass-through window is sized to encircle the unitary rigger loop without contacting the unitary rigger loop.

In certain embodiments, the pass-through window being elongate in a longitudinal direction of the outer belt and defining a length of about 0.5"-4.0" and a height of about 0.25"-1.75".

In certain embodiments, the padding member comprises a medium density closed cell foam.

In certain embodiments, the strap comprises a continuous tubular webbing with a fall-rated tensile strength.

In certain embodiments, the strap is permanently affixed to the sleeve member.

In certain embodiments, the sleeve member comprises stretch woven nylon.

In certain embodiments, the first buckle comprises a double-back buckle formed by two metallic loops affixed to one end of the inner belt.

In certain embodiments, the outer belt comprises: a thermoplastic fabric layer mounting the second part of the hook-and-loop fastening interface, and a laminate fabric layer.

In certain embodiments, the laminate fabric layer provides the plurality of carriers.

In certain embodiments, the plurality of carriers comprises a MOLLE interface integrally formed in the laminate fabric layer.

In certain embodiments, the thermoplastic fabric layer comprises a laminate of nylon fiber layers.

In certain embodiments, the thermoplastic fabric layer comprises a plurality of cutouts for imparting flexibility to the outer belt.

In certain embodiments, the outer belt further comprises a binding strap for affixing the second buckle to the outer belt.

In certain embodiments, the second-buckle comprises a quick-release buckle.

In certain embodiments, the outer belt defines a height greater than a height of the inner belt.

In certain embodiments, a utility belt for integration with a safety belt comprises a safety belt buckle and a rigger loop, comprising: a first part of a hook-and-loop fastening interface extending from an inner face of the utility belt; a thermoplastic fabric layer mounting the first part of the hook-and-loop fastening interface; a laminate fabric layer defining a plurality of MOLLE carriers and permanently affixed to the thermoplastic fabric layer; a quick-release buckle for closing the utility belt; an adjustable binding affixing the quick-release buckle to the thermoplastic fabric layer; and a pass-through window laser-cut through the thermoplastic fabric layer and the laminate fabric layer, the pass-through window cap.

In certain embodiments, the pass-through window is elongate in a longitudinal direction of the utility belt and defining a length of about 0.5"-3.0" and a height of about 0.25"-1.5".

In certain embodiments, a method of equipping, comprises: donning an inner belt by passing the inner belt through one or more pant belt loops and fastening a first buckle of the inner belt, the inner belt defining an inner face and an outer face, the inner belt comprising: a sleeve member, a padding member extending through the sleeve, a strap extending through the sleeve member and comprising a unitary rigger loop extending from the outer face, the strap being fall-rated, wherein the unitary rigger loop is integrally formed from the strap of the inner belt by folding the strap upon itself, wherein the unitary rigger loop extends parallel to a longitude of the inner belt, wherein the first buckle is affixed to the strap, a first fastener of a hook-and-loop fastener interface provided at the outer surface of the inner belt; removably mounting an outer belt to the inner belt, the outer belt defining an inner surface and an outer surface, the outer belt comprising: a pass-through window formed in the outer belt and sized to accommodate the unitary rigger loop, a plurality of carriers provided on the outer surface of the outer belt, a second buckle affixed to the outer belt for closing the outer belt, and a second fastener of a hook-and-loop fastener interface provided at the inner surface of the outer belt for selectively attaching to the first fastener with the unitary rigger loop extending through the pass-through window.

In certain embodiments, a retention lanyard is attached to the rigger loop and mounting accessory equipment to the outer belt.

BRIEF DESCRIPTION OF THE DRAWINGS

The invention can be completely understood in consideration of the following detailed description of various embodiments of the invention in connection with the accompanying drawings.

Figure 1:
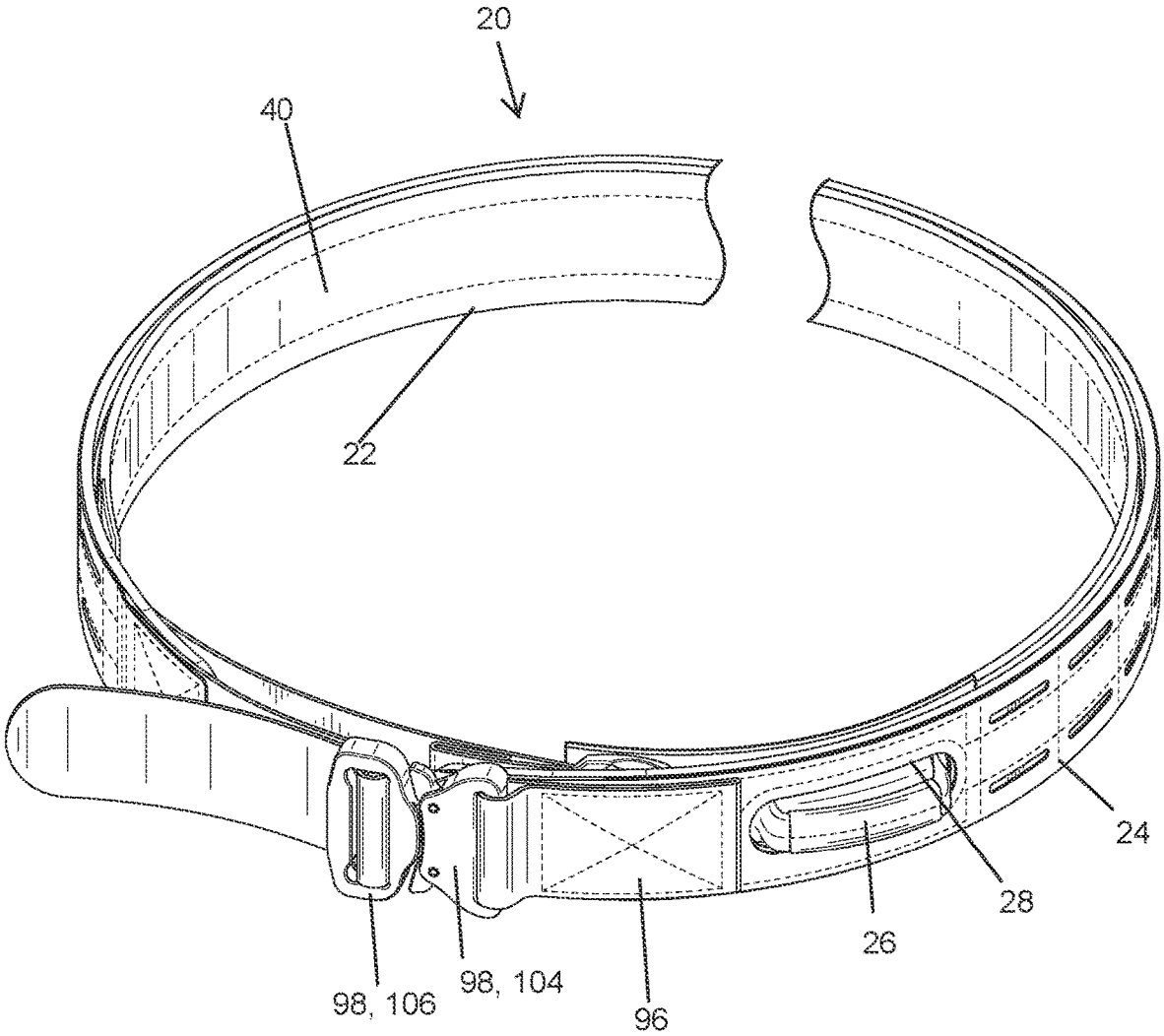
FIG. 1 shows a top, front perspective view of an embodiment of an integrated belt assembly, as detailed herein.
Figure 2:
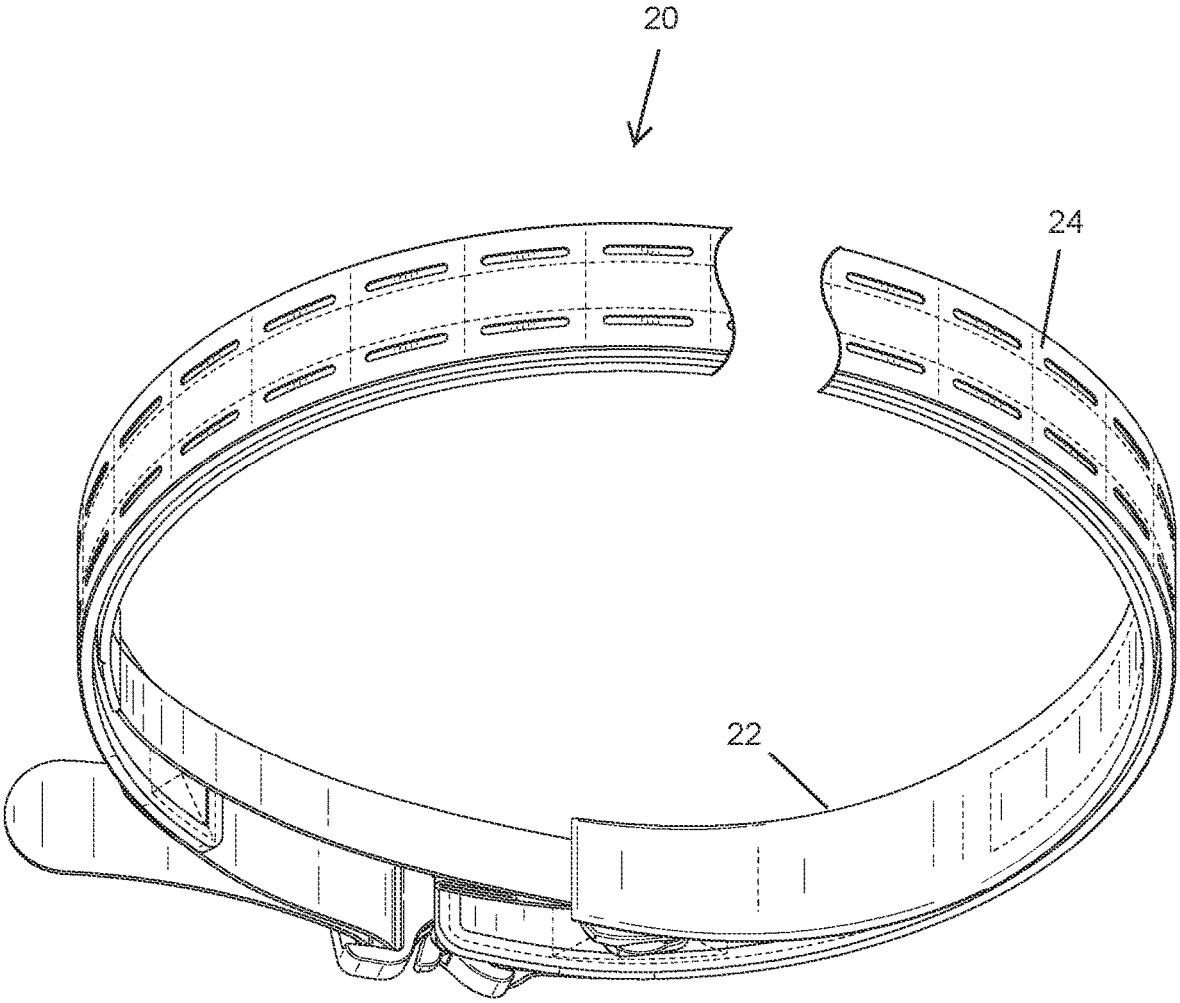
FIG. 2 shows a bottom, rear perspective view thereof.
Figure 3:
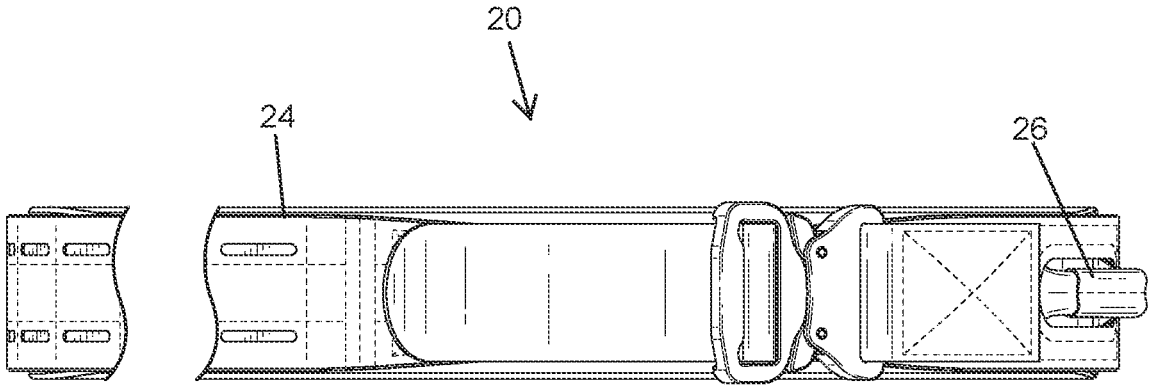
FIG. 3 shows a front view thereof.
Figure 4:
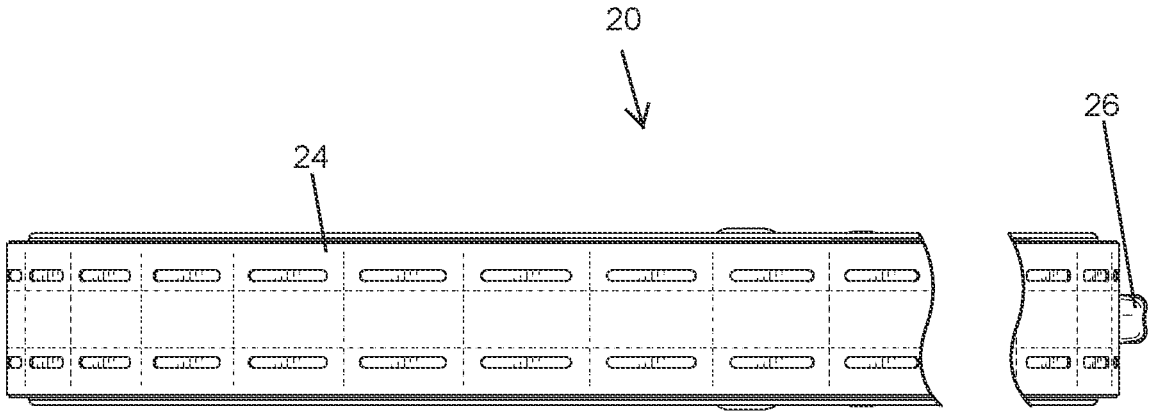
FIG. 4 shows a rear view thereof.
Figure 5:
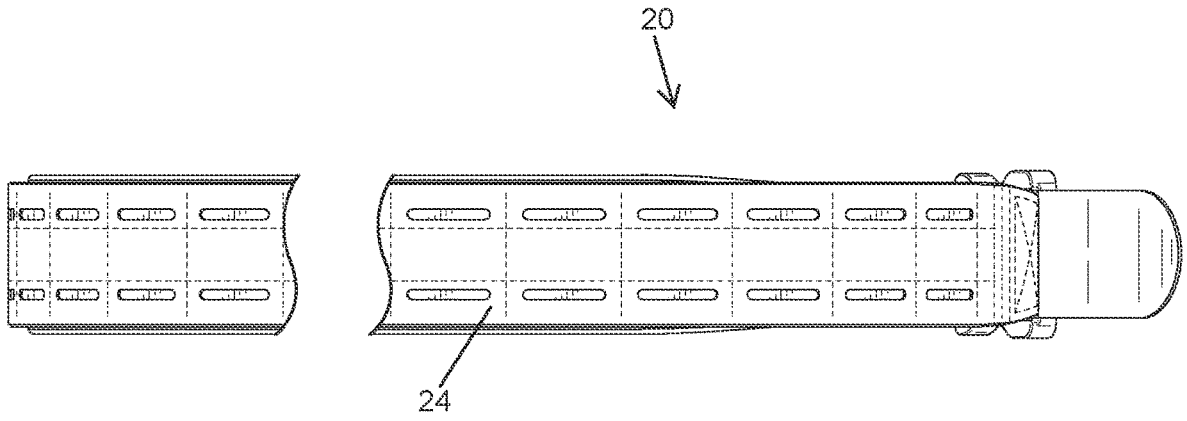
FIG. 5 shows a left view thereof.
Figure 6:
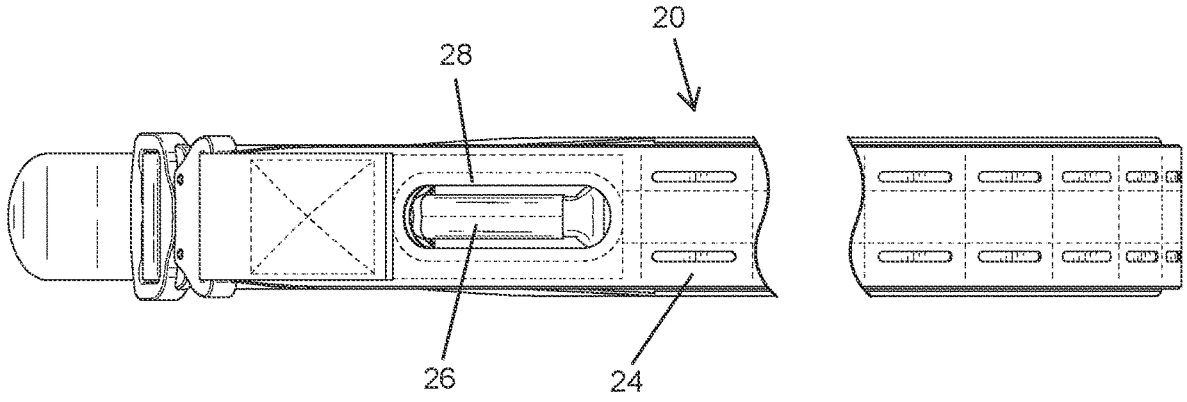
FIG. 6 shows a right view thereof.
Figure 7:
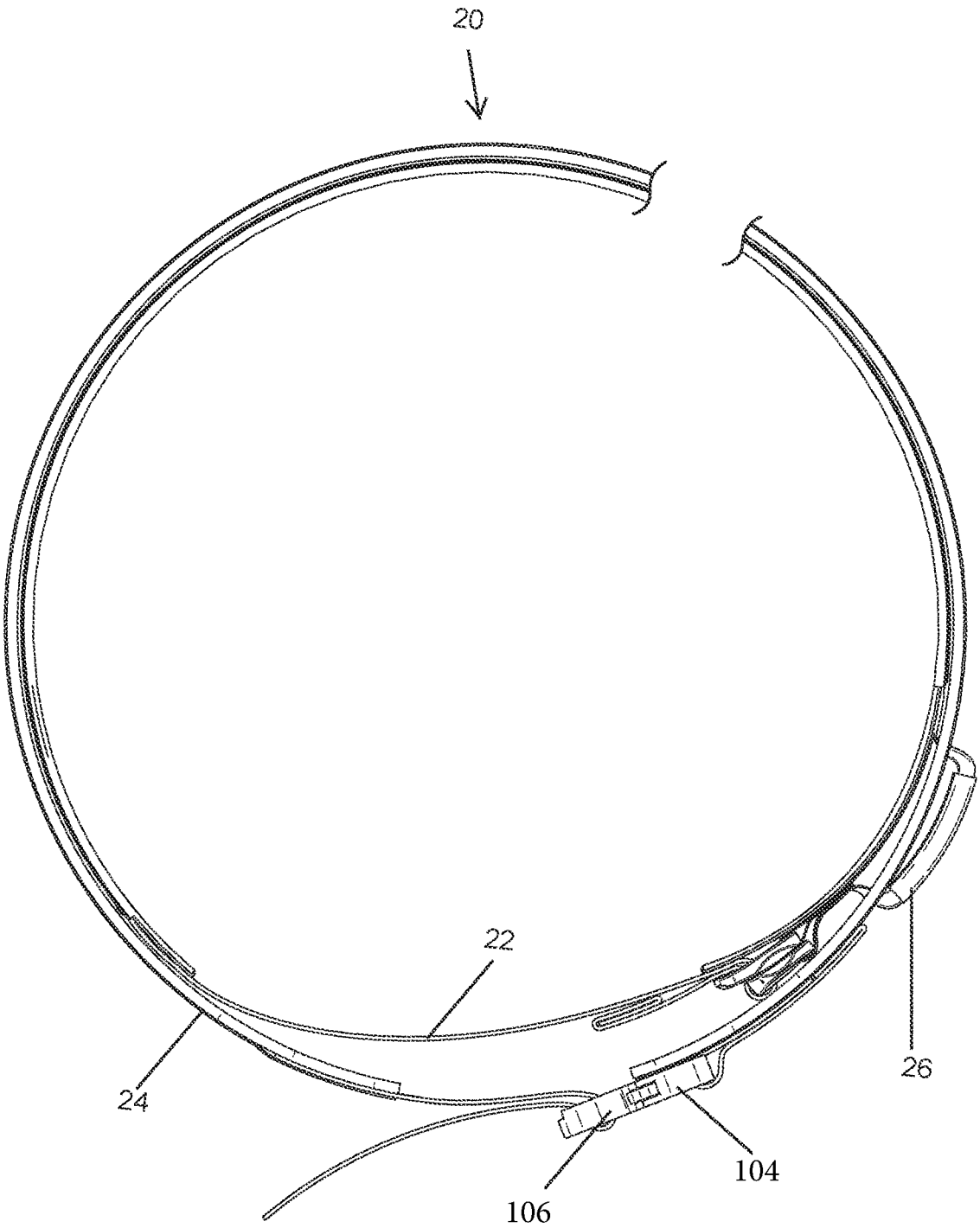
FIG. 7 shows a top view thereof.
Figure 8:
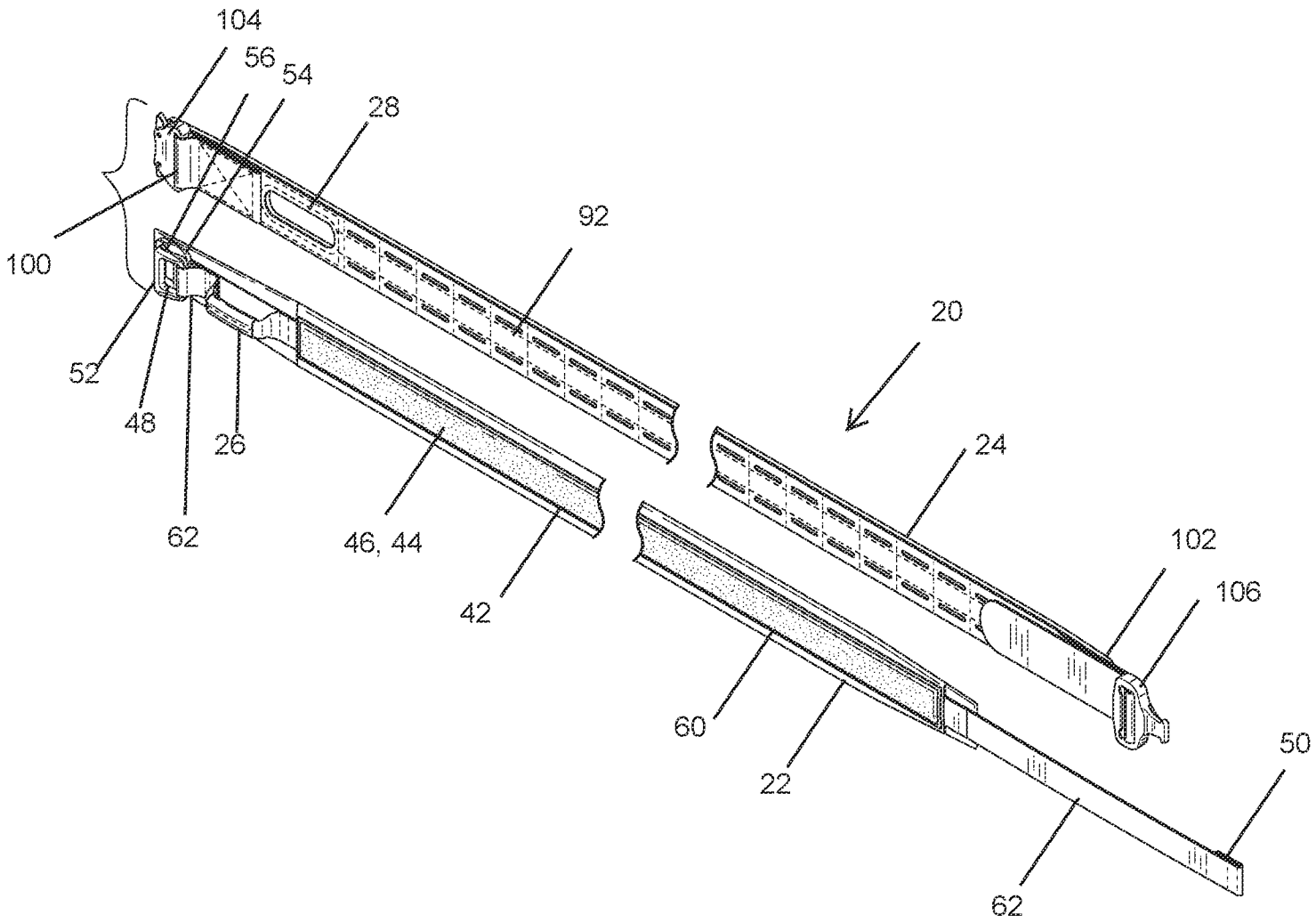
FIG. 8 shows a top, front exploded perspective view thereof.
Figure 9:
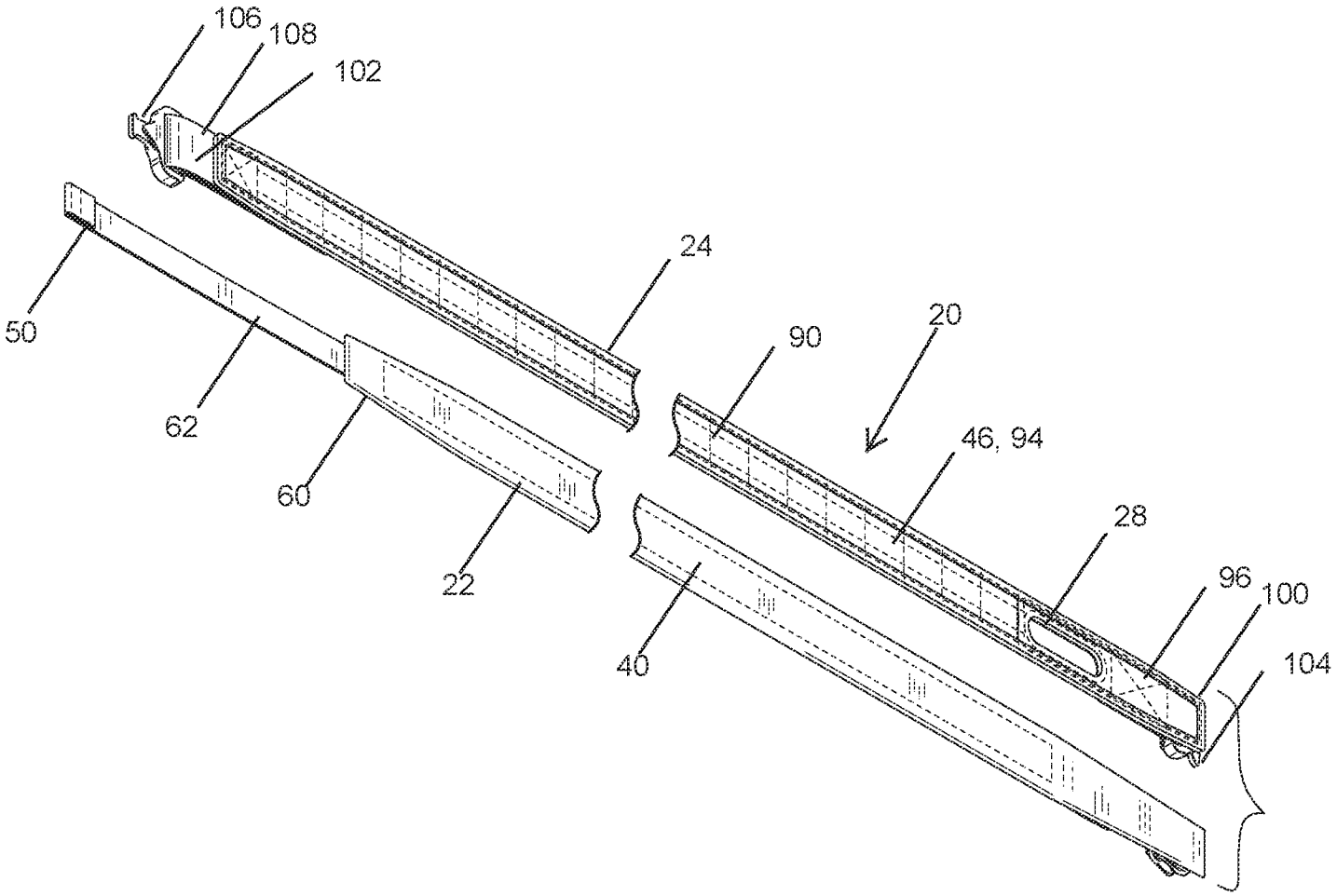
FIG. 9 shows a top, bottom, rear exploded perspective view thereof.
Figure 10:
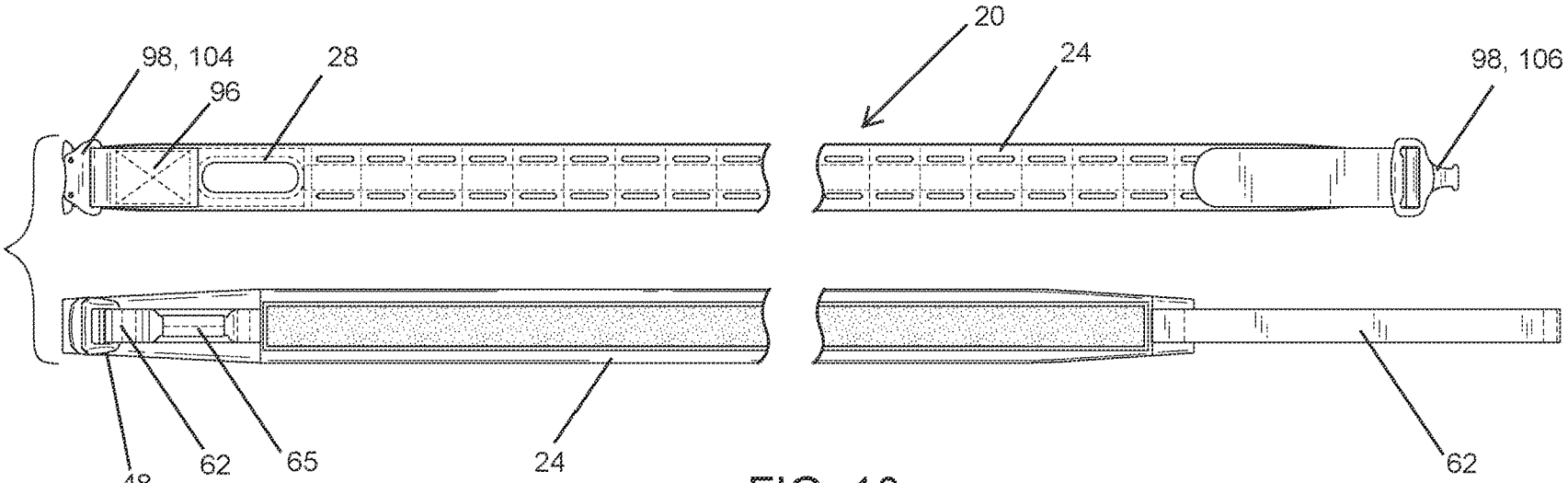
FIG. 10 shows a front exploded view thereof.
Figure 11:
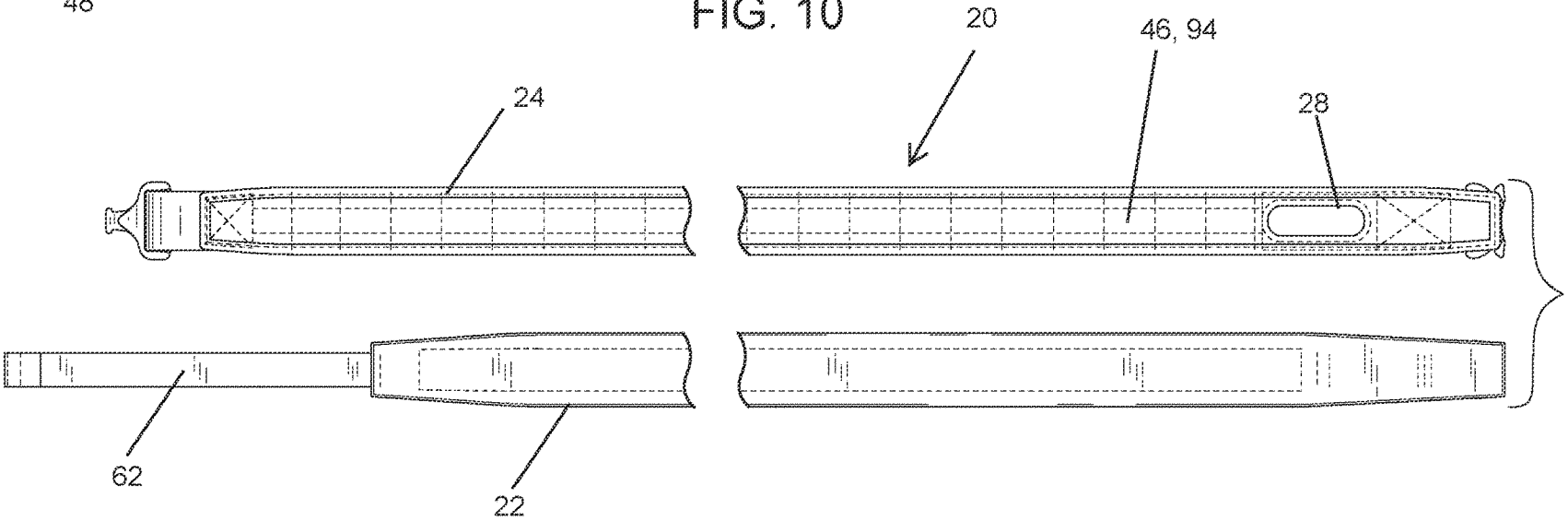
FIG. 11 shows a rear exploded view thereof.
Figure 12:
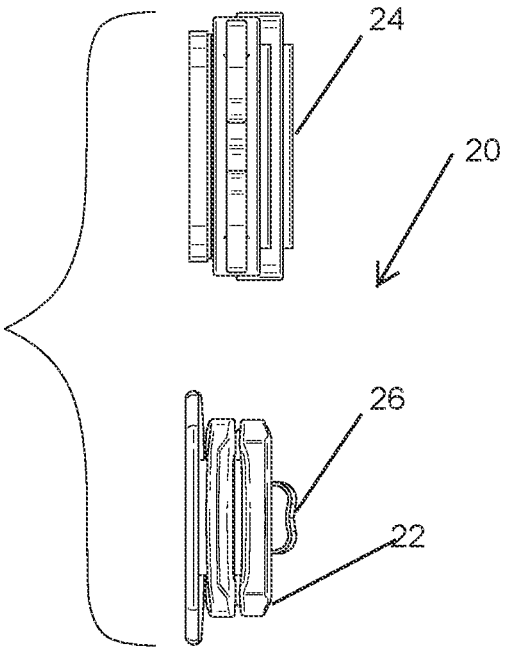
FIG. 12 shows a left exploded view thereof.
Figure 13:
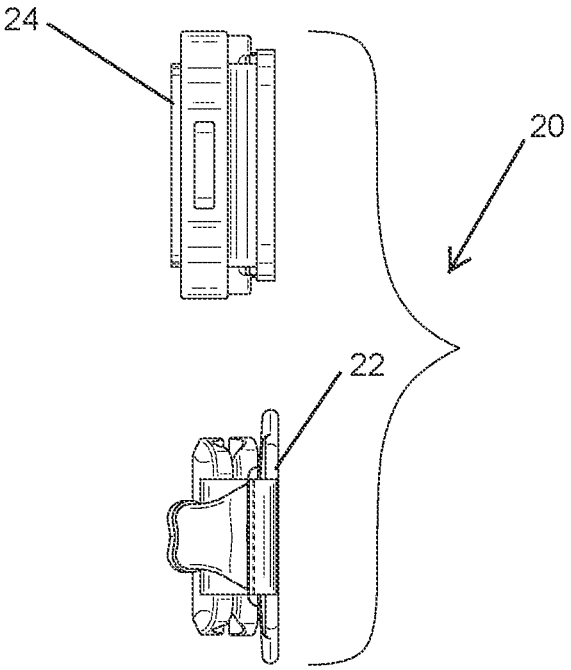
FIG. 13 shows a right exploded view thereof.
Figure 14:
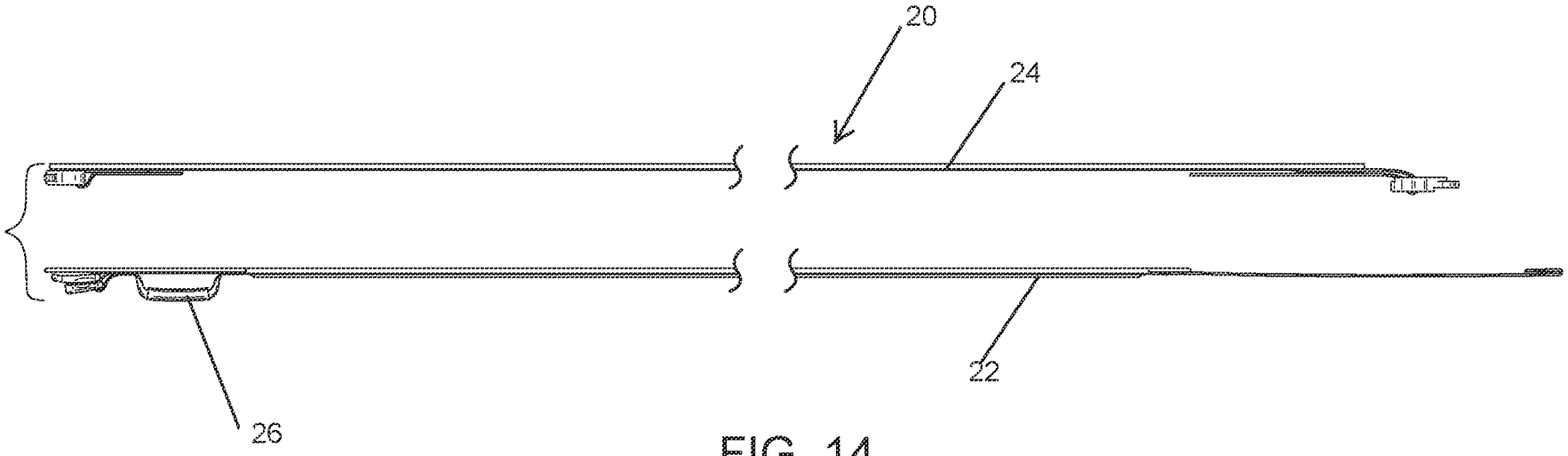
FIG. 14 shows a top exploded view thereof.
Figure 15:
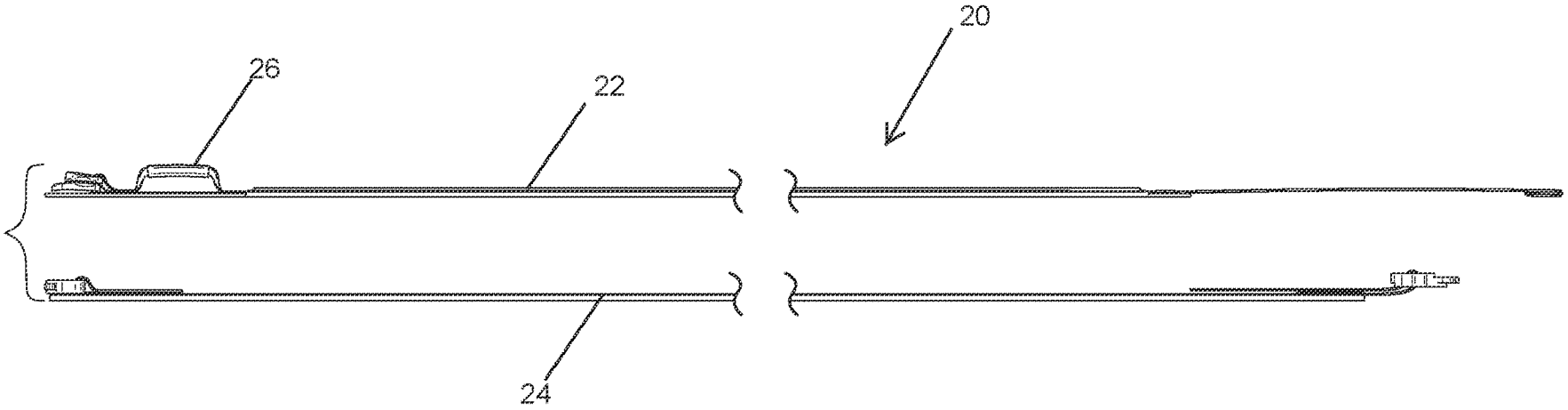
FIG. 15 shows a bottom exploded view thereof.
Figure 16:
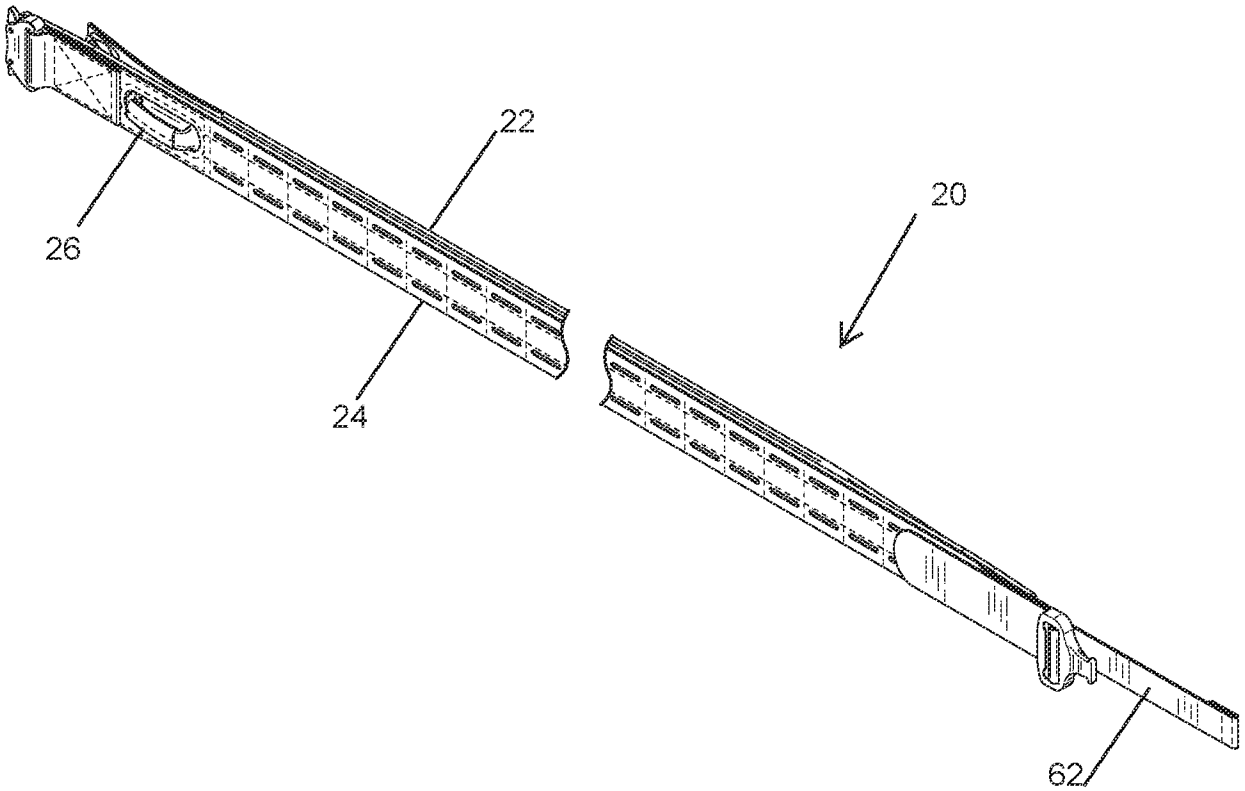
FIG. 16 shows a top, front perspective view thereof in an open position.
Figure 17:
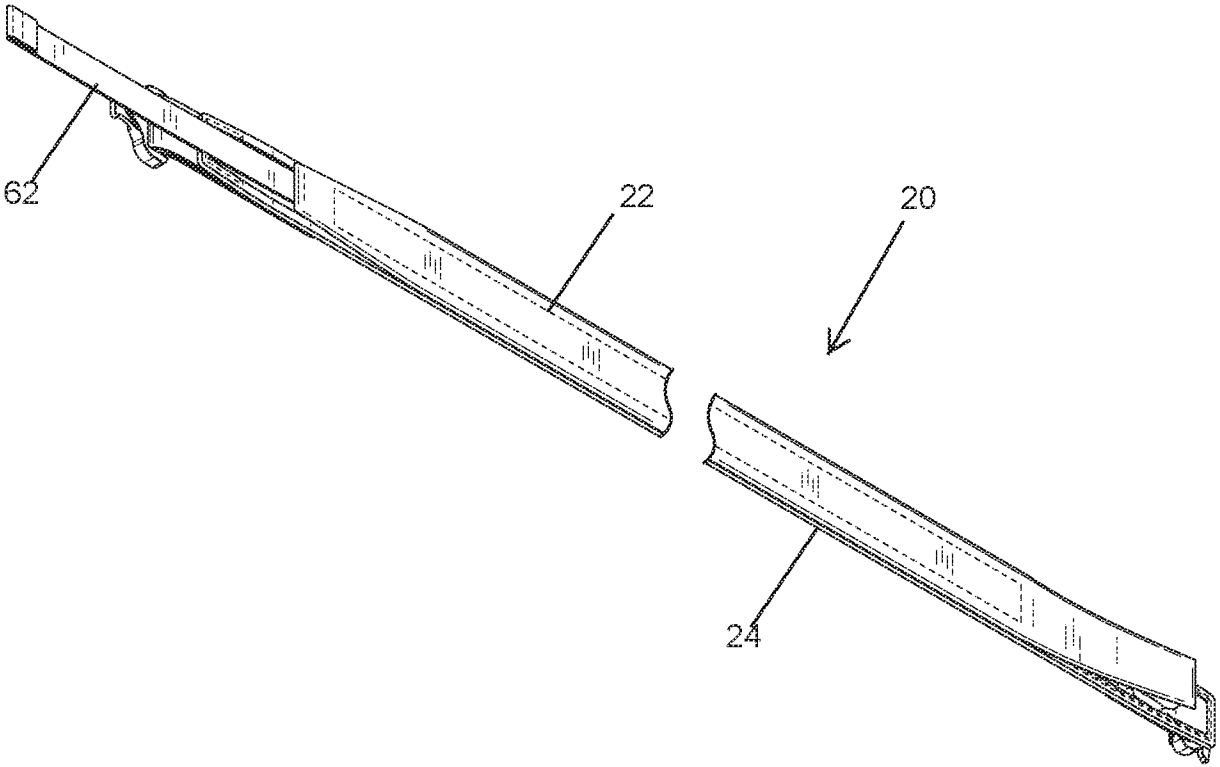
FIG. 17 shows a bottom, rear perspective view thereof.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Referring to FIG. 1-7, an embodiment of an integrated belt assembly 20 includes an inner belt 22 and an outer belt 24 that are selectively and removably attached in a substantially coextensive arrangement. In certain embodiments, the inner belt 22 is also referred to as a "safety belt" due to being load rated to serve as an attachment for a fall protection retention lanyard, such retention lanyard being configured for secure attachment to a relatively fixed structure such as a vehicle, building, scaffolding, and the like. In other embodiments, the outer belt 24 may also be referred to as a "utility belt" or "accessory belt" due to being configured for carrying various types of equipment. In one embodiment, the outer belt 24 is arranged to be assembled with the inner belt 22 without hindering or obstructing the fall protection functionality of the inner belt 22. In the illustrated embodiment, a rigger loop 26 of the inner belt extends through a pass-through window 28 of the outer belt 24 allowing the rigger loop 26 to serve as a tie-in point for attachment to a safety tether such as a retention lanyard.

Referring to the embodiments included in FIGS. 8-11, the inner belt 22 defines an inner face 40 and an outer face 42. The outer face 42 of the illustrated embodiment includes a loop fastener 44 arranged in a field along a portion of the outer face 42. The loop fastener 44 is part of a hook-and-loop fastener interface 46 configured to selectively attach to the outer belt 24.

In certain embodiments, the inner belt 22 includes an attachment mechanism, such as a buckle 48 that is fall-rated and permanently affixed to a first longitudinal end 50 of the inner belt 22 for selective attachment to a second longitudinal end 52. The illustrated embodiment of buckle 48 is a metallic double-back style buckle including a first loop 54 and a second loop 56 that may each be generally rectangular, the first loop 54 being relatively larger. In other embodiments, inner belt 22 may include other attachment mechanisms that securely attach ends 50, 52, including buckles, clasps, ties, and snaps.

Figure 18:
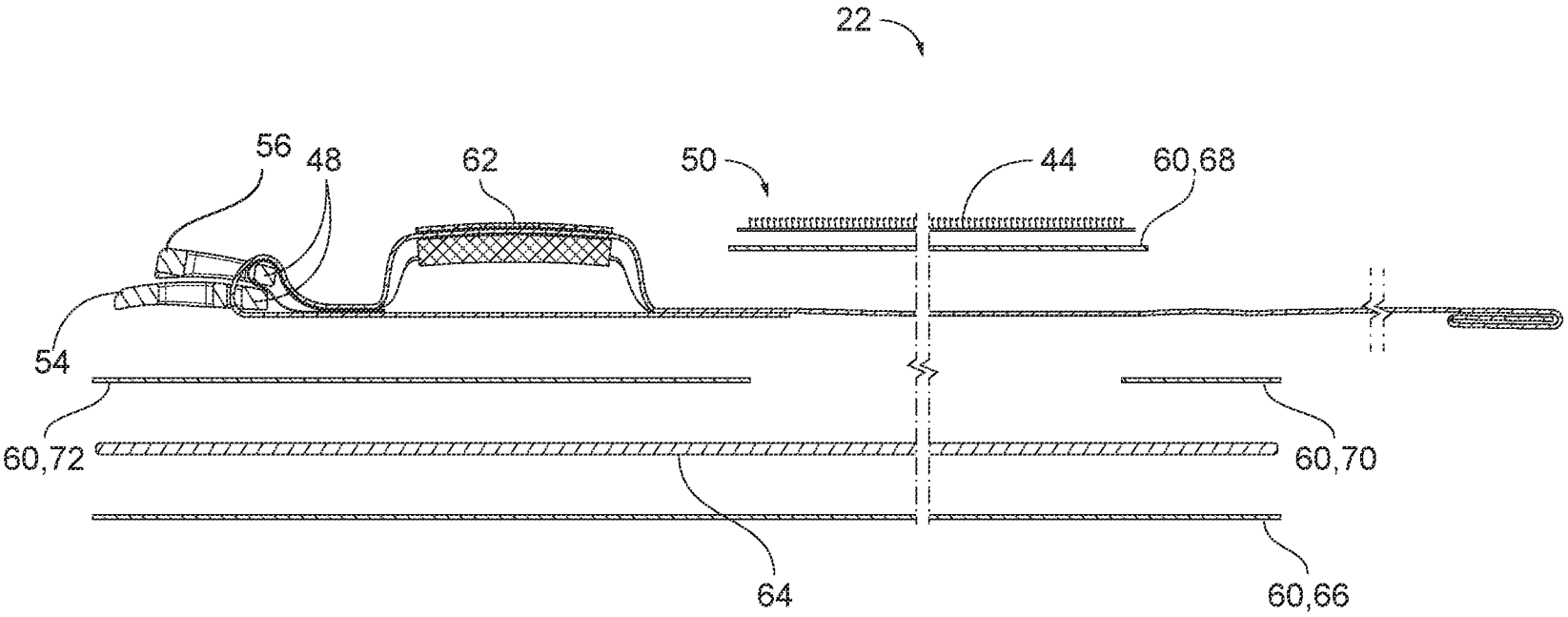
FIG. 18 shows a cross-sectional, exploded view of the inner belt according to an embodiment.

Referring also to FIG. 18-21, in certain embodiments, the inner belt 22 may have multiple layers for improved comfort and utility. In the illustrated embodiment, the inner belt 22 includes a sleeve member 60, a strap 62 that is fall-rated passing through the sleeve 60, and a padding member 64 extending through the sleeve member 60. In certain embodiments, the strap 62 and the padding member 64 may be fastened or freely slideable within the sleeve member 60. In certain embodiments, the strap 62 at the first longitudinal end 50 permanently mounts the buckle 48 by looping through the buckle 48 and being stitched to itself. Referring to FIGS. 8-11, a distal end of the strap 62 at the second longitudinal end 52 of the inner belt 22 cinches to the buckle 48, for example by passing underneath proximal portions of each of the first loop 54 and the second loop 56 and then looping back between distal ends of the first and second loops 54, 56, as shown in FIG. 18.

In certain embodiments, the rigger loop 26 is unitarily formed from a portion of the strap 62 and therefore is also formed of a fall-rated fabric. In further embodiments, the strap 62 at the first longitudinal end 50 is looped over itself and permanently stitched at each longitudinal end of the rigger loop 26. The rigger loop 26 is laterally compressed onto itself and stitched with longitudinal seams 65 (FIG. 10), providing an accessible anchoring tie-in point for a carabineer, clip, or similar retention device. In such embodiments, the strap 62 is a single continuous length from the distal end 62, along the entire length of inner belt 22 to form the rigger loop 26 and attach buckle 48, and then doubling back under itself and being attached to itself as shown in FIG. 18. In that way, the strap 62 and buckle 48 bear all of the force from anything attached to or pulling on the rigger loop, 26.

In some embodiments, the sleeve member 60 defines the outer face 42 of the inner belt 22 and mounts the loop fastener 44. The sleeve member 60 may be formed from four or five pieces sewn together, the pieces including two long pieces 66, 68 that substantially define the longitudinal extent of the sleeve member 60 and two or three shorter pieces 70, 72 that enclose the sleeve and form cuff-like ends to the sleeve member 60.

In certain embodiments, the sleeve member 60, the strap 62, and the padding member 64 may be formed of various materials for providing suitable utility and comfort. In some embodiments, the sleeve member 60 may be formed of stretch woven nylon, the strap 62 may be formed of a continuous piece of 1-1.5"-wide tubular nylon webbing with a fall-rated strength, and the padding member 64 may be a medium-density closed cell foam. Generally, the inner belt 22 is sized to slide through belt loops of pants and has a width of about 2" or less. The width of the loop fastener 44 of the hook-and-loop fastener interface 46 may be the same or slightly less, in some embodiments having a width of about 1.25-1.5". In certain embodiments, the primary load-carrying function of the inner belt 22 is performed by the strap 62 and buckle 48. The padding member 64 is located between the strap 62 and the user, providing the user a layer of cushioning from the strap 62. In these embodiments, the sleeve member 60 serves to cover the padding member 64 and portions of the strap 62, protect the strap 62 and padding member 64 from abrasion, and is configured to combine those elements and serve as a platform for the loop fastener 44.

Referring also to FIGS. 1 and 8-11, in certain embodiments, the outer belt 24 defines an inner face 90 and an outer face 92. The inner face 90 of the illustrated embodiment includes a hook fastener 94 arranged in a field along a portion of the inner face 90. The hook fastener 94 is another part of the hook-and-loop fastener interface 46 for selective attachment to the loop fastener 44 of the inner belt 22. In certain embodiments, a first binding 96 is affixed to the outer belt 24 to retain an attachment mechanism, for example a buckle 98 to a first longitudinal end 100 of the outer belt for selective attachment to a second longitudinal end 102. The illustrated buckle 98 has a first portion 104 on the first longitudinal end 100 and a second portion 106 on the second longitudinal end 102. A second binding 108 permanently affixes the second portion 106 of the buckle 98 to the second longitudinal end 102, and one or both of the first and second bindings 96, 108 may be adjustable. The illustrated buckle 98 is a metallic quick-release buckle, although various types of attachment mechanisms, including buckles may be used. Notably, the buckle 98 of the outer belt 24 in the illustrated embodiment is independent and separately operable from the buckle 48 of the inner belt 22.

Figures 19, 20, 21:
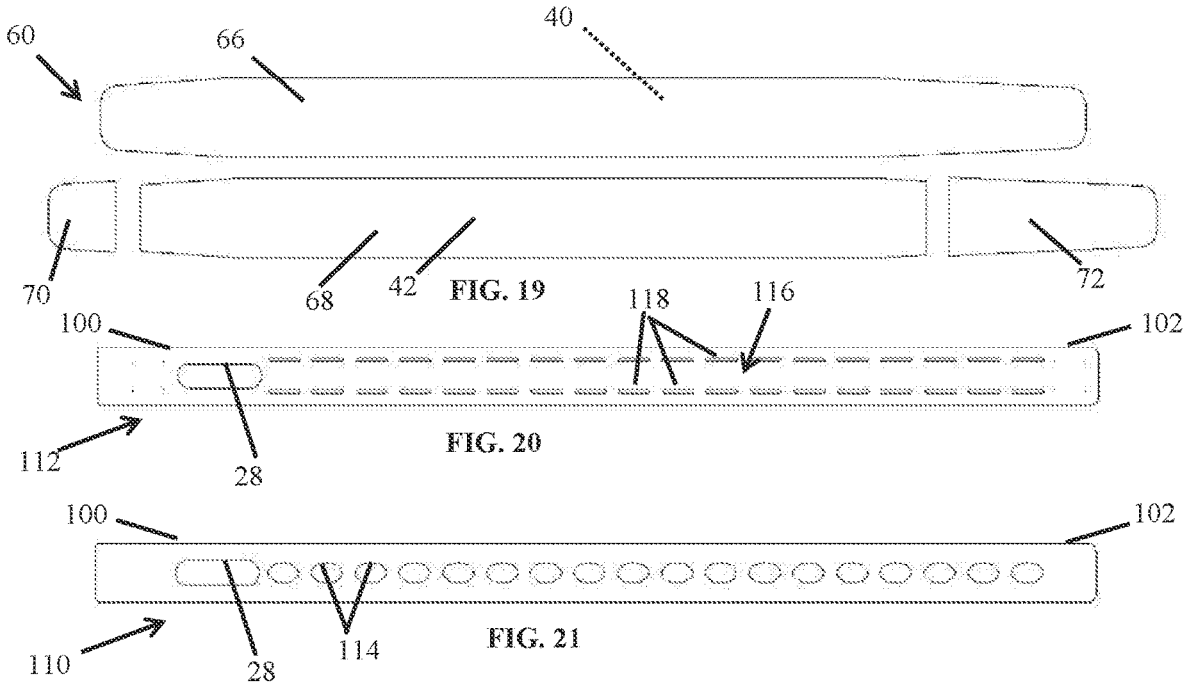
FIG. 19 shows an exploded view of the sleeve according to an embodiment.
FIGS. 20-21 show front views of layers of the outer belt according to an embodiment.

Referring also to FIGS. 20 and 21, in certain embodiments, the outer belt 24 may be formed of various layers and materials for providing suitable utility and comfort. In some embodiments, the outer belt 24 includes an inner layer 110 formed of a thermoplastic fabric for mounting the hook fastener 94 of the hook-and-loop fastening interface 46, and an outer layer 112 formed of a nylon that in certain embodiments is relatively less rigid than the inner layer 110. In certain embodiments, the thermoplastic fabric of the more rigid inner layer 110 may be a laminate of woven polymer layers formed under heat and pressure, such laminate providing improved rigidity and impact resistance over typical fabrics. In one such embodiment, the inner layer 110 may be a thermoplastic composite produced by Milliken Textiles and sold under the trade name Tegris®. In certain embodiments, inner layer 110 is a composite fabric that provides impact resistance and stiffness at a lighter weight than traditional thermoplastics and composites. Such fabrics may be woven from tape yarns, which are manufactured with three polymer layers in an ABA construction. The outer, or 'A' layers melt at a lower temperature than the core 'B' layer. To consolidate, multiple layers of fabric are stacked together and heat and pressure is applied to form a rigid, impact resistant part.

In certain embodiments, the primary load carrying function of the outer belt 24 is performed by the inner layer 110 in combination with the buckle 98, and inner layer 110 may be provided with a series of cutouts 114 to improve flexibility and decrease weight. In some embodiments, the nylon laminate of the outer layer 112 may be a nylon laminate of 500 denier or 1000 denier, such as a three-layer laminate of 100% nylon in 500/1000 denier. In one such embodiment, the outer layer 112 may be a nylon laminate produced by Brookwood Companies Incorporated and sold under the trade name Squadron™. In general, the function of the outer layer 112 is to provide a covering for aesthetics and comfort over the inner layer 110. In certain embodiments, the outer layer 112 defines the outer face 92 of the outer belt 24 and includes a plurality of carriers 116 for attaching additional equipment and accessories. The carriers 116 can include hook and loop closures, loops, straps, buckles, snaps, slots, mounting hardware, threaded receivers for a screw, and the like. In the illustrated embodiment, the plurality of carriers 116 includes a field of slots 118 defining a Modular Lightweight Load-carrying Equipment (MOLLE) system. Various other carriers or combinations of carriers may be implemented on the outer face 92 of the outer belt 24, such as pouch attachment ladder system (PALS) webbing, hook-and-loop fastening systems, snaps, buckles, clips, and the like. Generally, the outer belt 24 is sized to provide a suitable load-supporting base for equipment, and may be the same width or wider than the inner belt 22. In some embodiments, the outer belt 24 is not sized to slide through belt loops of a wearer's pants, and is secured to the wearer by the hook-and-loop fastener interface 46 and buckle 98.

In certain embodiments, the pass-through window 28 is unitarily formed as a cutout from the outer belt 24. In some embodiments, the pass-through window 28 of the illustrated embodiment is laser-cut through both the inner layer 110 and the outer layer 112. In various embodiments, the pass-through window 28 is generally elongate, rectangular or oval shaped, and sized to accommodate the rigger loop 26. The pass-through window may be elongate in a longitudinal direction of the outer belt 24 and defining a length of about 0.5"-4.0" and, preferably of about 0.5"-3.0", a height of about 0.25"-1.75" and, preferably about 0.25"-1.5" In certain embodiments, the pass-through window 28 is centrally located widthwise at the first longitudinal end 100 of the outer belt 24.

In use, the integrated belt assembly 20 may be worn about a wearer's waist. As noted, in certain embodiments the inner belt 22 is sized to fit within a wearer's pant belt loops to provide secure attachment to the wearer. In some embodiments, the outer belt 24 is attached around the inner belt 22 by adherence between the loop fastener 44 and the hook fastener 94, and aided by the buckle 98. In certain embodiments, the outer belt 24 may have a greater height that does not fit through belt loops. In some embodiments, the inner belt 22 has a height of about 1-2.5" and the outer belt 24 has a height of about 2-4" or more. The loop fastener 44 and the hook fastener 94 fields may have a height of about 1.25-1.5". The outer belt is aligned over the inner belt such that when the outer belt is placed over the inner belt and affixed to the inner belt and user via the hook and loop fastener system 46 and/or the buckle 98, the rigger loop 26 is aligned with the pass-through window 28 such that the rigger loop 26 is readily accessible through the pass-through window 28. This allows a user to attach/detach a safety retention lanyard to the fall-rated inner belt 22 via a carabineer or the like, for example when entering or exiting a helicopter. The rigger loop 26 is centrally and closely mounted to the inner belt 22, integrated with the strap 62, providing a direct transfer of the wearer's weight load to the retention lanyard. In other words, the weight of the wearer can be borne by the rigger loop 26 at an angle perpendicular to the wearer without the outer belt 24 obstructing a retention lanyard. Because the outer belt 24 does not obstruct the rigger loop 26, the user can quickly attach/detach the safety retention lanyard and is less likely to attach the safety retention lanyard to the wrong location. The rigger loop 26 also allows for the safety retention lanyard to be temporarily attached at both ends to the rigger loop 26 for transport. The combination of inner and outer belt provides the wearer with a two-belt system that holds up the pants of the wearer like a traditional belt, performs as fall-rated safety belt, and allows the wearer to carry all of the gear normally carried on a gear belt in a compact, comfortable, and integrated system. The combination of inner and outer belts accomplishes the functions of what would normally take three or more different belts and/or harnesses.

In certain embodiments, the rigger loop 26 is readily accessible for tethered attachment and detachment to a fixed structure. A retention tether line (not shown) may be carried by a user with both ends attached to the rigger loop 26, and one end selectively attached to a fixed structure when needed.

The illustrated loop fastener 44 and the hook fastener 94 may be oppositely arranged on the outer belt 24 and the inner belt 22, respectively, or may be provided in an alternating arrangement on each of the inner and outer belts. Various other attachment structures, alone or in combination, may be implemented for temporary attachment of the inner belt 22 and the outer belt 24, including clips, snaps, buckles, slots, magnets, hooks, straps, mechanical fasteners and the like.

The pass-through window 28 may be selectively openable, for example by clips, a mechanical gate, or hook-and-loop, allowing the outer belt 24 to mount to the inner belt 22 even while the rigger loop 26 is engaged with a retention lanyard. In other embodiments, the pass-through window 28 may be substituted with a full or partial break in the outer belt 24. In the case of a partial break, the pass-through window may be open on one end all the way to the edge of the outer belt 24, forming a "C" shape, In embodiments with a full break, the outer belt 24 being substantially only held by the hook-and-loop fastening interface 46 and/or belt loops of the wearer's pants. The rigger loop 26 may be sized or oriented differently, for example extending transverse to the longitude of the inner belt 22, and the pass-through window 28 may have a corresponding shape to accommodate any such variations in the rigger loop 26.

The term "fall-rated" as used herein encompasses various standards and metrics for a tensile strength that is suitable to safely arrest the accidental free fall of a person without breaking. In some example standards, such fall-rated equipment can withstand loads of about 3,000-5,000 pounds (lbs.) (13.25-22.25 kN). In some embodiments, the fall-rated strap 62 of the inner belt 22 has a load rating of 4,000 lbs (17.79 kN) corresponding to United States military specifications under Mil-W-5625-1. The principles of the present invention may be applicable to a variety of uses as a fall-protection measure, such as climbing, repelling, and the like. Such uses may include other military or para-military uses such as tethering to a boat, helicopter, airplane or other vehicle, rock climbing, along with other jobs with fall risks including construction, utilities, confined space entry, drilling, and the like. These other uses may be subject to alternative requirements for fall-rated equipment.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. For example, some or all of the permanently stitched connections in the illustrated embodiments may be replaced by gluing, ultrasonic welding, removable connections, or the like. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. An integrated belt assembly, comprising:

an inner belt configured to fit in the belt loops of a wearer's pants, the inner belt defining an inner face and an outer face, the inner belt comprising:

a sleeve member, a padding member extending through the sleeve, a strap extending through the sleeve member and comprising a unitary rigger loop extending from the outer face, the strap being fall-rated, wherein the unitary rigger loop is integrally formed from the strap of the inner belt by folding the strap upon itself, wherein the unitary rigger loop extends parallel to a longitude of the inner belt, a first buckle affixed to the strap for closing the inner belt, a first fastener of a hook-and-loop fastener interface provided at the outer surface of the inner belt; and an outer belt defining an inner surface and an outer surface, the outer belt comprising:

a pass-through window formed in the outer belt and configured to allow the unitary rigger loop to extend through the pass-through window, a plurality of carriers provided on the outer surface of the outer belt, a second buckle affixed to the outer belt for closing the outer belt, and a second fastener of a hook-and-loop fastener interface provided at the inner surface of the outer belt and configured for selectively attaching to the first fastener, while allowing the unitary rigger loop to extend through the pass-through window.

2. The integrated belt assembly of claim 1, wherein the unitary rigger loop is laterally compressed and reinforced relative to the remainder of the belt.

3. The integrated belt assembly of claim 1, wherein the strap, the unitary rigger loop, and the first buckle provide a fall-rated tensile strength.

4. The integrated belt assembly of claim 1, wherein the pass-through window is sized to encircle the unitary rigger loop without contacting the unitary rigger loop.

5. The integrated belt assembly of claim 1, the pass-through window being elongate in a longitudinal direction of the outer belt and defining a length of about 0.5"-4.0" and a height of about 0.25"-1.75".

6. The integrated belt assembly of claim 1, wherein the padding member comprises a medium density closed cell foam.

7. The integrated belt assembly of claim 1, wherein the strap comprises a continuous tubular webbing with a fall-rated tensile strength.

8. The integrated belt assembly of claim 1, wherein the strap is permanently affixed to the sleeve member.

9. The integrated belt assembly of claim 1, the sleeve member comprising stretch woven nylon.

10. The integrated belt assembly of claim 1, the first buckle comprising a double-back buckle formed by two metallic loops affixed to one end of the inner belt.

11. The integrated belt assembly of claim 1, wherein the outer belt comprises: a thermoplastic fabric layer mounting the second part of the hook-and-loop fastening interface, and a laminate fabric layer.

12. The integrated belt assembly of claim 11, the laminate fabric layer providing the plurality of carriers.

13. The integrated belt assembly of claim 12, the plurality of carriers comprising a MOLLE interface integrally formed in the laminate fabric layer.

14. The integrated belt assembly of claim 11, the thermoplastic fabric layer comprising a laminate of nylon fiber layers.

15. The integrated belt assembly of claim 11, the thermoplastic fabric layer comprising a plurality of cutouts for imparting flexibility to the outer belt.

16. The integrated belt assembly of claim 1, the outer belt further comprising a binding strap for affixing the second buckle to the outer belt.

17. The integrated belt assembly of claim 1, the second-buckle comprising a quick-release buckle.

18. The integrated belt assembly of claim 1, the outer belt defining a height greater than a height of the inner belt.

19. A method of equipping, comprising:

donning an inner belt by passing the inner belt through one or more pant belt loops and fastening a first buckle of the inner belt, the inner belt defining an inner face and an outer face, the inner belt comprising:

a sleeve member, a padding member extending through the sleeve, a strap extending through the sleeve member and comprising a unitary rigger loop extending from the outer face, the strap being fall-rated, wherein the unitary rigger loop is integrally formed from the strap of the inner belt by folding the strap upon itself, wherein the unitary rigger loop extends parallel to a longitude of the inner belt, wherein the first buckle is affixed to the strap, a first fastener of a hook-and-loop fastener interface provided at the outer surface of the inner belt;

removably mounting an outer belt to the inner belt, the outer belt defining an inner surface and an outer surface, the outer belt comprising:

a pass-through window formed in the outer belt and sized to accommodate the unitary rigger loop, a plurality of carriers provided on the outer surface of the outer belt, a second buckle affixed to the outer belt for closing the outer belt, and a second fastener of a hook-and-loop fastener interface provided at the inner surface of the outer belt for selectively attaching to the first fastener with the unitary rigger loop extending through the pass-through window.

20. The method of claim 19, further comprising attaching a retention lanyard to the rigger loop and mounting accessory equipment to the outer belt.

* * * * *